United States Patent [19]

Sallenbach

[11] 4,372,681

[45] Feb. 8, 1983

[54] STREAMLINED LABEL VERIFICATION TECHNIQUE

[75] Inventor: M. Douglas Sallenbach, Costa Mesa, Calif.

[73] Assignee: Avery International Corp., San Marino, Calif.

[21] Appl. No.: 178,729

[22] Filed: Aug. 18, 1980

[51] Int. Cl.[3] ..... B65C 3/08; B65C 9/08

[52] U.S. Cl. ..... 356/72; 156/299; 156/541; 156/DIG. 46; 356/71; 428/42

[58] Field of Search ..... 356/71–72; 250/548, 570; 156/DIG. 23, 33, 46–47, 378, 351, 540–542, 299–302, 562, 271, 249; 271/258–259; 428/40–42; 40/2 R; 283/18–19

[56] References Cited

U.S. PATENT DOCUMENTS

| | | | |
|---|---|---|---|
| 2,551,364 | 5/1951 | Coakley | 271/259 |
| 2,819,195 | 1/1958 | Huber | 156/299 |
| 3,607,537 | 9/1971 | von Hofe et al. | 156/277 |
| 4,303,461 | 12/1981 | LaMers | 156/DIG. 33 |

FOREIGN PATENT DOCUMENTS

| | | | |
|---|---|---|---|
| 1369085 | 6/1964 | France | 428/42 |
| 544601 | 4/1942 | United Kingdom | 250/548 |
| 1491224 | 11/1977 | United Kingdom | 40/2 R |

*Primary Examiner*—William H. Punter

*Attorney, Agent, or Firm*—Poms, Smith, Lande & Rose

[57] ABSTRACT

The present system involves the use of a backing tape with pressure-sensitive labels mounted along one portion of the width of the backing tape, and at least one continuous strip of material carrying related indicia, for example in bar code form, is mounted on a different portion of the backing tape. As the label is applied to containers, the bar code or other information associated with each label is also read to insure correspondence between the contents of the containers being packaged, as programmed into the optical reader at the label applicator head, with the bar code information identifying the label which is being applied to the product. The pressure-sensitive labels are individually mounted on the backing tape, either in the form of die cut or butt cut labels, while the associated bar code information is on the continuous strip. Accordingly, the individual labels are applied to the containers as the backing tape passes over the peeling blade, but the additional continuous strip carrying the bar code product identification is re-wound with the backing tape.

16 Claims, 6 Drawing Figures

STREAMLINED LABEL VERIFICATION TECHNIQUE

FIELD OF THE INVENTION

The present invention relates to a labelling technique whereby labels may be verified as they are applied to a product such as drugs or the like, but the bar code or other identifying data is not applied to the product along with the label.

BACKGROUND OF THE INVENTION

When labels are to be applied to drug products, particular care must be taken to insure that the proper label is applied to the proper drug product. This is accomplished, in accordance with normal practice by printing a bar code onto the pressure-sensitive label, and optically reading the bar code as the label is being applied to the container for the drugs. The operator carefully sets the optical reader equipment to correspond with the drugs being labeled, and if there should be any mismatch, with the actual bar code on the labels not corresponding to that which has been set up for the optical reader, the labelling process is stopped.

Unfortunately, with the small size of the ampules, or bottles for many drug products, the presence of the identifying bar code on the label causes problems. For example, when very small vials or ampules are employed, later processing steps such as optically sensing of particulate matter in the vial may not be practical, because the label blocks nearly all of the available surface of the container. Further, with the limited space on the vial for a label, it is often desirable to use the entire available label space for printed information other than the identifying information included in the bar code.

While some systems have been proposed for accomplishing this type of function, for example, see Coakley U.S. Pat. No. 2,551,364, granted May 1, 1951, the actual use of cutting devices as the label is being applied, is inconvenient, and may cause injury to technicians, as well as posing a waste disposal problem for the cutaway portions of the labels at the labeling station.

Accordingly, a principal object of the present invention is to provide a streamlined label identification technique, which is not subject to the problems outlined hereinabove.

SUMMARY OF THE INVENTION

In accordance with the present invention, a series of separate pressure-sensitive labels are mounted on one area across the width of a backing tape, and a continuous strip of material carrying identification or verification data is mounted on another area of the strip. Then, as the labels are applied to ampules or other containers for the products, the verifying indicia may be read to assure application of the proper labels to the drugs; and the identifying material may be re-wound along with the backing tape, so that the ampules or other containers for the products only receive the labels per se and not the collateral identifying information. This permits the subsequent optical verification of particulate material within the container, if desired; and, alternatively, permits the use of a larger label carrying other information, instead of wasting space on the label with the identifying bar code.

In accordance with other features of the invention, the row of individual labels may be centrally mounted on the backing tape, and two separate continuous strips may be mounted on either side of the labels to carry any desired supplemental information, such as the identifying bar code, and if desired, a series of consecutive numbers whereby the labels may be counted.

In accordance with another feature of the invention, the labels may be printed in more than one color, and a corresponding composite bar code may be employed using different colors, and it has been determined that such a composite bar code will still be properly read by the optical reader.

Other objects, features, and advantages of the invention will become apparent from a consideration of the following detailed description and from the drawings.

DETAILED DESCRIPTION

Figure 1:
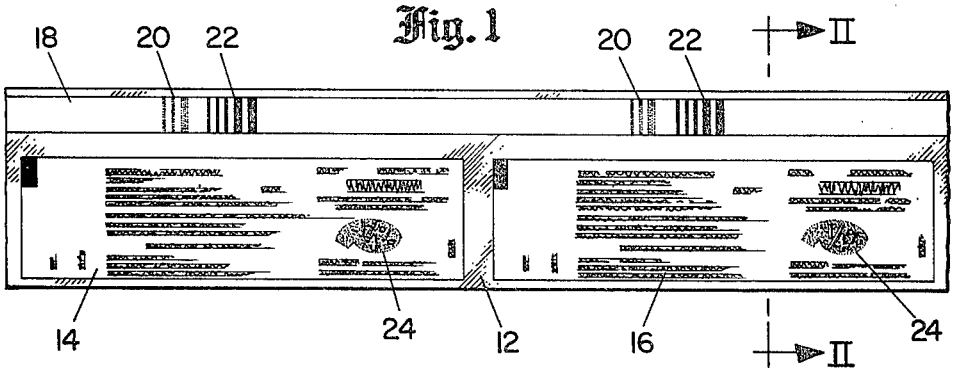
FIG. 1 shows a backing tape with a series of die cut separate labels mounted along one portion of the width of the backing tape, and a continuous strip along another portion of the width of the backing tape, carrying bar code product identification information.

Referring more particularly to the drawings, FIG. 1 shows a backing tape 12 carrying a series of pressure sensitive labels 14, 16, and a continuous strip 18 of material which may actually be cut from the same sheet material from which the labels 14 and 16 are formed. However, while the labels 14 and 16 have been individually separated, by the removal of the matrix of the sheet material the strip 18 remains as one long continuous strip, so that it will not be separated from the backing tape when it passes over the peeling blade associated with the label applicator.

Figure 2:
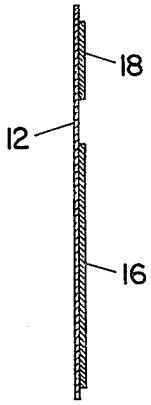
FIG. 2 is a cross-sectional view taken along lines II—II of FIG. 1.

FIG. 2 is a cross-sectional view through the backing member 12, one of the labels 16, and the continuous identification strip 18. The view of FIG. 2 is taken along lines II—II of FIG. 1.

As mentioned hereinabove in the introduction, the bar code 20, 22 provides a digital indication of the product as set forth on the label and which is intended to be included in the vials which are being labeled. In practice, the person who is setting up to have the vials of a particular material labeled will set the optical reader equipment associated with the label applicator to identify the products which are being labeled. Then, if there is any discrepancy between the code read by the optical reader, and that which has previously been set into the reader equipment, the labelling process will be automatically stopped. This is a procedure which is known per se for labels where the bar code is actually included on the label. However, in the present case, the individual labels are separated from the backing tape as they pass over the peeling blade, and the continuous identification tape carrying the digital data 20, 22, is wound up as the mylar tape is rewound.

Incidentally, in accordance with normal practices, the labels 14 and 16 have adhesive material secured to their lower surfaces, and a conventional release agent is present between the layer of pressure sensitive adhesive and the backing tape 12. This permits the labels to be readily separated from the backing tape as the tape is brought around the edge of the peeling blade in the applicator, but when these labels are thereafter firmly pressed against the bottles, the pressure sensitive material causes them to strongly adhere to the vials or ampules.

Incidentally, in FIG. 1, the symbol 24 and the portion of the bar code designated 20 may be of one color, while the remainder of the label and the bar code 22 may be of normal black colored ink. By allowing suitable spacing between the portions of the code designated 20 in one color and that designated 22 in normal black ink, allowance for color registration on successive printings is made, and it has been determined that the optical reader can accommodate both the additional spacing between the code groups as well as the difference in color, and still correctly read the information. By way of example, the colored printing 24 might include the concentration of the drug solution, and this information would also be included in the same colored bar code group 20.

Figure 3:
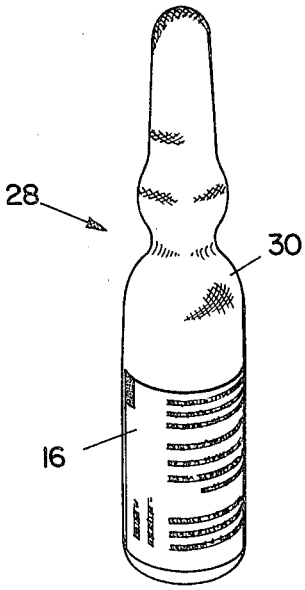
FIG. 3 shows an ampule to which one of the labels of FIG. 1 has been secured.

The ampule 28 of FIG. 3 has been labeled with a label such as label 16 from FIG. 1, and one portion 30 of the ampule 28 remains clear and is not covered with a label or any other blocking information. In accordance with one of the tests for product certification conducted by certain drug companies on particular types of products, the ampule 28 is subsequently vibrated and, by known optical means, a particle count is taken through the transparent portion 30 of the ampule 28. Of course, if the portion of the label carrying the bar code had remained as part of the label, there would have been no clear or transparent zone 30 through which the particulate count test could have been made.

Figure 4:
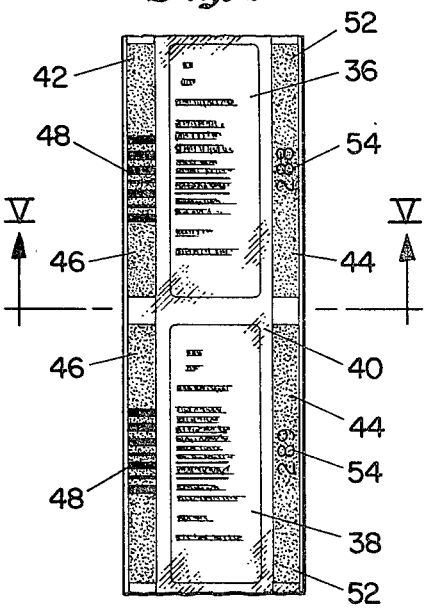
FIG. 4 shows an alternative embodiment of the invention in which transparent labels are employed and in which two continuous indicia-carrying strips are provided.
Figure 5:
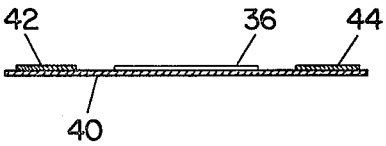
FIG. 5 is a cross-sectional view taken along lines V—V of FIG. 4.

FIGS. 4 and 5 show an alternative labelling strip configuration including a pair of labels 36 and 38, both of which are transparent, a transparent backing tape 40, and a pair of continuous strips 42 and 44 on which additional information may be provided. For example, the strip 42 is provided with white ink backing zones 46 and bar code indicia 48 adjacent each of the labels. Further, the matching continuous strip 44 on the other side of the labels may carry additional information. For example, the zones 52 on the continuous tape 44 are also printed or colored with white ink, and the numbers "288" and "289", identified by the reference numbers 54, may be applied to these white painted areas to indicate the sequential number of each of the labels on the roll. Other information or indicia could also be placed on either or both of the continuous strips 42 and 44. As in the case of the strip 18 in FIG. 1, the continuous strips 42 and 44 are not dispensed at the peeling blade with the die cut labels 36 and 38; instead, they are rolled up with the backing tape. In addition, the configuration of FIG. 4 has the advantage, that, with the two continuous strips 42 and 44 both remaining, the roll of backing tape is more balanced and may be more evenly wound up.

Figure 6:
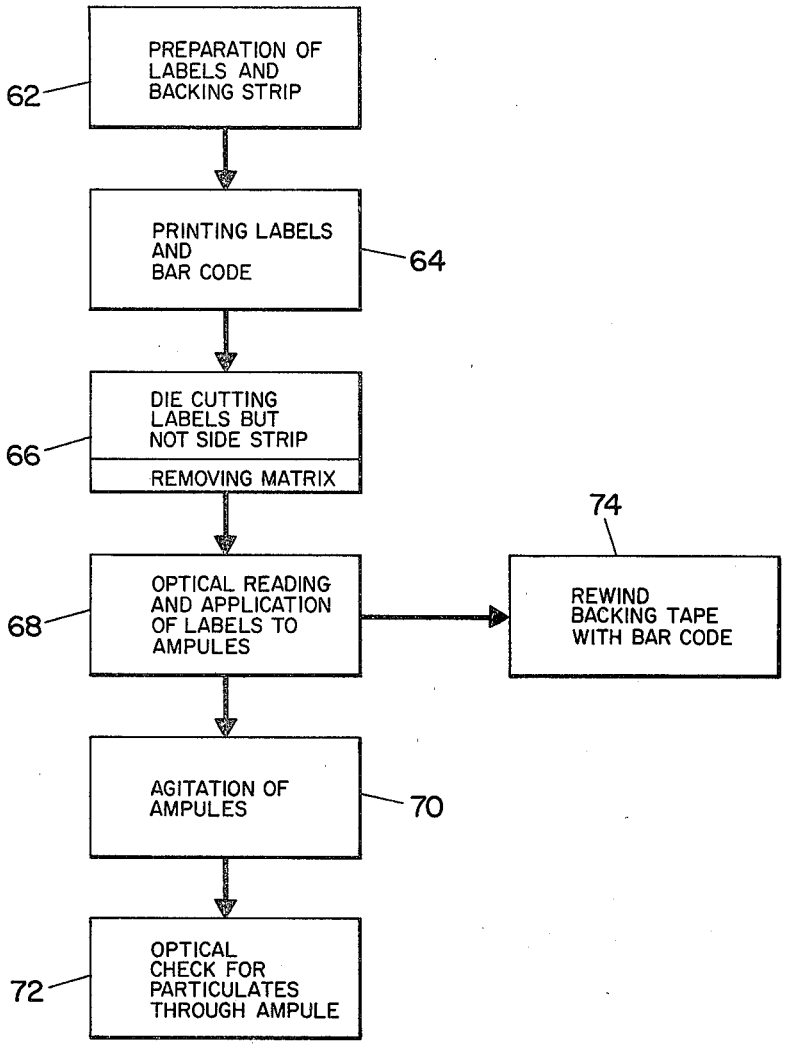
FIG. 6 is a process flow diagram indicating one method utilizing the principles of the present invention.

FIG. 6 is a diagrammatic showing of the process steps described hereinabove. First, as indicated by block 62, the labels and the continuous strips are mounted on the backing tape, which is usually made of polyester, the labels, the bar codes, and other indicia are printed on the label stock material and on the continuous strip made of the same material, the labels are die cut and formed to the configuration shown in FIGS. 1 and 2, or 4 and 5. The backing tape and the associated labels and continuous identification strips are then wound on a reel or prepared in fan-folded label form for feeding to an applicator. Incidentally, the printing and die cutting steps are indicated in FIG. 6 by blocks 64 and 66, respectively.

As indicated in FIG. 6, when the labels are die cut, the additional step of removing the matrix which surrounds the die cut labels is necessary. The labels may also be butt cut, in which case they would abut one-another.

The next step, indicated by block 68 in FIG. 6, is the combined optical reading of the bar code on the continuous strip and the application of the labels to the ampules or other containers for drugs or other products. As mentioned above, in the event of a failure in obtaining a match between the pre-programmed bar code and that which is read from the continuous strip, the labelling process is stopped.

The two blocks 70 and 72 represent process steps which may be undertaken in some cases but not in others. These involve the agitation or vibration of ampules or containers, and the optical particulate check, and are normally employed in cases where the solution is subject to possible deterioration with age, heat, or other adverse factors. In order to accomplish the check, the ampules are agitated or vibrated and optically checked in accordance with known techniques by directing light beams through the clear zone 30 of the ampules (see FIG. 3) and determining interruption or reduction in intensity of the transmitted light beam or light beams. Block 74 represents the step of rewinding the backing tape along with the continuous strips which contain the collateral information such as the bar code, or the successive numbering of the individual labels, as shown in FIG. 4.

Incidentally, in passing, it is noted that all of the machinery needed to accomplish the general steps set forth herein are known and available. In this connection, one apparatus suitable for applying labels to ampules is Avery Model 6905 Vertical Ampule Labelling System, available from Avery Label Systems Division, of Avery International Corporation, 777 East Foothill Boulevard, Azusa, California 91702.

In closing, it is to be understood that the foregoing description and the accompanying drawings illustrate the presently preferred technique in implementing the invention; however, departures from the precise structures and method steps are also contemplated. Thus, by way of example and not of limitation, both transparent and opaque labels and backing strips may be employed, and digital or other machine reactable indicia other than bar codes may be employed. Also, the optical checking of the contents of the bottle following labelling may be for opacity, presence of particulate contaminants, or merely verify that the bottle has been filled. Accordingly, the present invention is not limited to that precisely as disclosed hereinabove.

What is claimed is:

1. A method for verifying the accuracy of labels to be applied to containers containing drugs or other products requiring special handling comprising the steps of:

preparing a backing tape with individual pressure sensitive labels mounted across one portion of the width of said backing tape, and a continuous strip of label stock material mounted on another portion of the width of said backing tape;

printing the label including identification of the product;

printing a machine readable identification of the product on the continuous strip, adjacent the label;

checking the machine readable identification on said continuous strip as said labels are being applied to the containers; and rewinding the continuous strip along with the backing tape following the checking step and the application of labels to the containers.

2. A method as defined in claim 1 including the step of printing bar code indicia on said continuous strip.

3. A method as defined in claim 2 including the steps of printing the label in two colors and concurrently printing the bar code in two bar code indicia groups, with each group being in a different color.

4. A method as defined in claim 1 including the step of providing two separate continuous strips mounted on said backing tape, along opposite edges of said tape, and the step of printing different supplemental information on each continuous strip.

5. A method as defined in claim 1 including the additional step of applying a light colored background coloring to said continuous strip prior to said printing step.

6. A pressure sensitive label and backing tape assembly for the labelling of drugs and other products requiring special handling, comprising:

a backing tape;

individual printed pressure sensitive labels mounted along one portion of the width of said backing tape; and a continuous strip of label stock material mounted on another portion across the width of said backing tape, said continuous strip of label stock material bearing machine readeable indicia corresponding to the label and to the product requiring special handling.

7. A pressure sensitive label and backing tape assembly as defined in claim 6 including a second continuous strip bearing additional information mounted in another area across the width of said backing tape.

8. A pressure sensitive label and backing tape assembly as defined in claim 6 including printing in different colors on said label and corresponding printing in different colors in the machine readable indicia on said continuous strip.

9. A pressure sensitive label and backing tape assembly as defined in claim 6 wherein said labels are transparent.

10. A pressure sensitive label and backing tape assembly as defined in claim 6 wherein said continuous strip and said labels are of the same stock and are formed from a single sheet of material, and wherein said labels are die cut, with space between each label and between said labels and said continuous strip.

11. A method for verifying the accuracy of labels to be applied to containers containing drugs or other products requiring special handling comprising the steps of:

preparing a backing tape with individual pressure sensitive labels mounted across one portion of the width of said backing tape, and a continuous strip of flexible sheet material mounted on another portion of the width of said backing tape;

printing the label including identification of the product;

printing a machine readable identification of the product on the continuous strip;

checking the machine readable identification on said continuous strip as said labels are being applied to the containers; and rewinding the continuous strip along with the backing tape following the checking step and the application of labels to the containers.

12. A method as defined in claim 11 including the step of applying the label to a transparent container so that a portion of said transparent container is not covered by the label, and optically checking the contents of said bottle through the unobstructed portion of said container.

13. A method as defined in claim 12 including the step of vibrating the container prior to the optical checking step.

14. A pressure sensitive label and backing tape assembly for the labelling of drugs and other products requiring special handling, comprising:

a backing tape;

individual printed pressure sensitive labels mounted along one portion of the width of said backing tape; and a continuous strip of flexible sheet material mounted on another portion of the width of said backing tape, said continuous strip of sheet material bearing machine readable indicia corresponding to the label and to the product requiring special handling.

15. A method for verifying the accuracy of labels to be applied to containers containing drugs or other products requiring special handling comprising the steps of:

preparing a backing tape with individual pressure sensitive labels mounted across one portion of the width of said backing tape, and a continuous strip of label stock material mounted on another portion of the width of said backing tape;

printing the label including identification of the product in two colors;

printing a machine readable identification of the product on the continuous strip, adjacent the label in two different groups of indicia, in respectively different colors, corresponding to the different colored label information;

checking the machine readable identification on said continuous strip as said labels are being applied to the containers; and rewinding the continuous strip and the backing tape following the checking step and the application of labels to the containers.

16. A method for verifying the accuracy of labels to be applied to containers containing drugs or other products requiring special handling comprising the steps of:

preparing a backing tape with individual pressure sensitive labels mounted across one portion of the width of said backing tape, and a continuous strip of label stock material mounted on another portion of the width of said backing tape;

printing the label including identification of the product;

printing a machine readable identification of the product on the continuous strip, adjacent the label;

applying the label to a transparent container having an outer surface area slightly greater than the extent of said label so that a portion of said transparent container is not covered by the label;

checking the machine readable identification on said continuous strip as said labels are being applied to the containers;

rewinding the continuous strip and the backing tape following the checking step and the application of labels to the containers; and optically checking the contents of said bottle through the unobstructed portion of said transparent container;

whereby the information on said bar codes may be deleted from said label to improve the aesthetic appearance thereof and to facilitate the optical checking step.

* * * * *